US009333637B2

(12) United States Patent
Zhou

(10) Patent No.: US 9,333,637 B2
(45) Date of Patent: May 10, 2016

(54) MULTI-TOOL FOR FASTENERS

(71) Applicant: Chervon (HK) Limited, Wanchai (HK)

(72) Inventor: Hongtao Zhou, Nanjing (CN)

(73) Assignee: CHEVRON (HK) LIMITED, Wanchai (HK)

( * ) Notice: Subject to any disclaimer, the term of this patent is extended or adjusted under 35 U.S.C. 154(b) by 569 days.

(21) Appl. No.: 13/743,493

(22) Filed: Jan. 17, 2013

(65) Prior Publication Data

US 2013/0186663 A1 Jul. 25, 2013

(30) Foreign Application Priority Data

Jan. 19, 2012 (CN) ..... 2012 1 0016595
Jan. 19, 2012 (CN) ..... 2012 1 0016643

(51) Int. Cl.
*B25F 5/00* (2006.01)
*B25D 11/08* (2006.01)
*B25D 11/02* (2006.01)

(52) U.S. Cl.
CPC ..... *B25F 5/001* (2013.01); *B25D 11/02* (2013.01); *B25D 11/08* (2013.01)

(58) Field of Classification Search
CPC ..... B25F 5/001
USPC ..... 173/47, 48, 216, 171, 217; 310/47, 50
See application file for complete search history.

(56) References Cited

U.S. PATENT DOCUMENTS

| | | | | |
|---|---|---|---|---|
| 3,866,692 | A | 2/1975 | Stelljes | |
| 7,354,230 | B2 * | 4/2008 | Bauman | 408/239 R |
| 2010/0071923 | A1 * | 3/2010 | Rudolph et al. | 173/48 |
| 2010/0276168 | A1 * | 11/2010 | Murthy et al. | 173/93.5 |
| 2011/0174859 | A1 * | 7/2011 | Zhou et al. | 227/144 |
| 2012/0061443 | A1 * | 3/2012 | Chen et al. | 227/119 |

FOREIGN PATENT DOCUMENTS

| | | |
|---|---|---|
| CN | 101367206 | 2/2009 |
| GB | 1451258 | 1/1974 |

* cited by examiner

*Primary Examiner* — Nathaniel Chukwurah
(74) *Attorney, Agent, or Firm* — Greenberg Traurig, LLP

(57) ABSTRACT

The multi-tool for fasteners includes a housing, a power device, a transmission device coupled to the power device, an output device coupled to the transmission device, and a switching device that can be switched between at least two operating modes. In a first operating mode, the output device moves in a reciprocating manner without rotation along an axial direction. In a second operating mode, the output device rotates with an intermittently increasing torque about a circumferential direction. The switching device may include a limiting member and the limiting member can be moved between a first position and a second position. Further, in the first position the output device is in the first operating mode, and in the second position the output device is in the second operating mode.

19 Claims, 7 Drawing Sheets

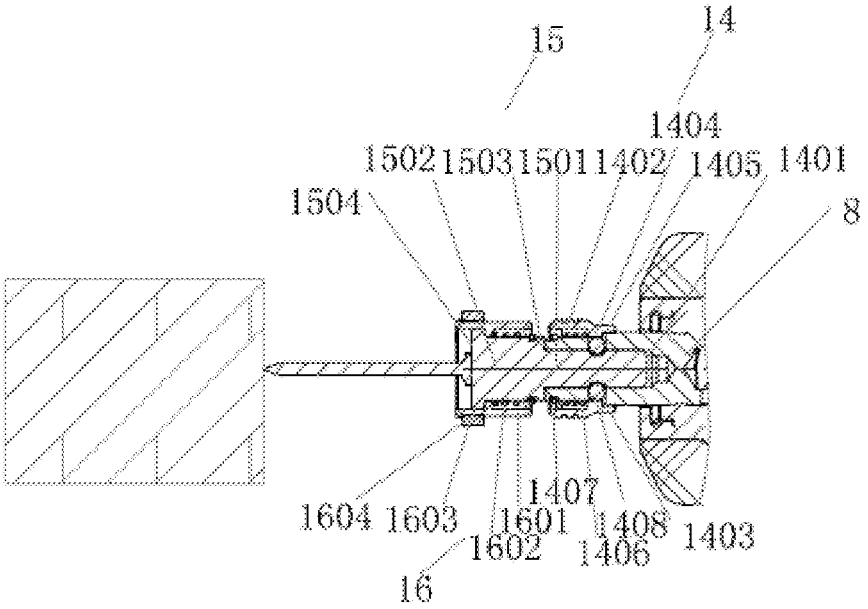
FIG. 8-A
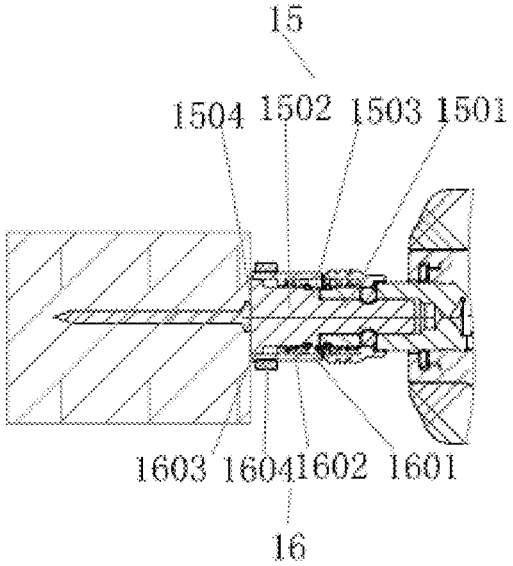
FIG. 8-B

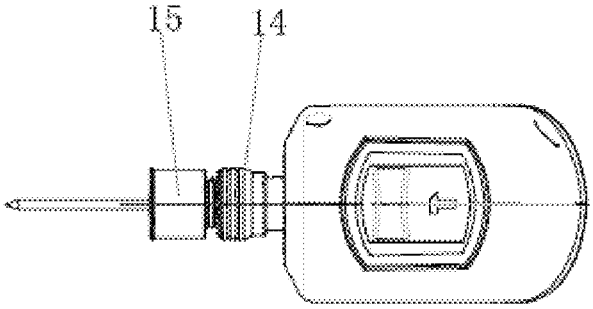
FIG. 9
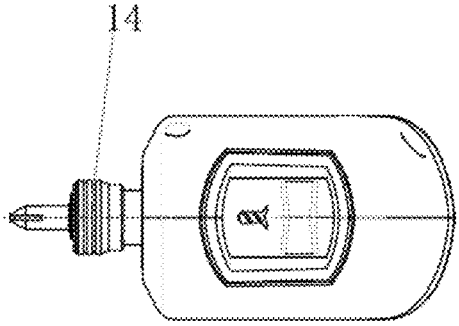
FIG. 10
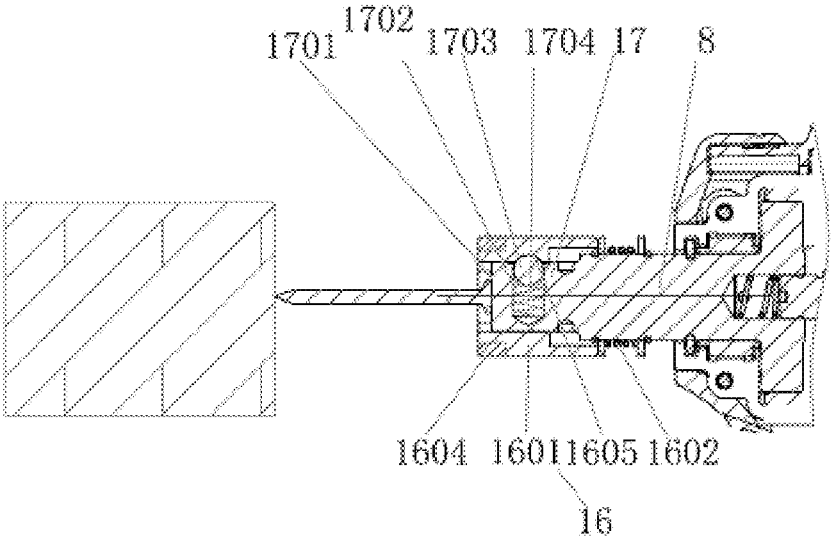
FIG. 11-A

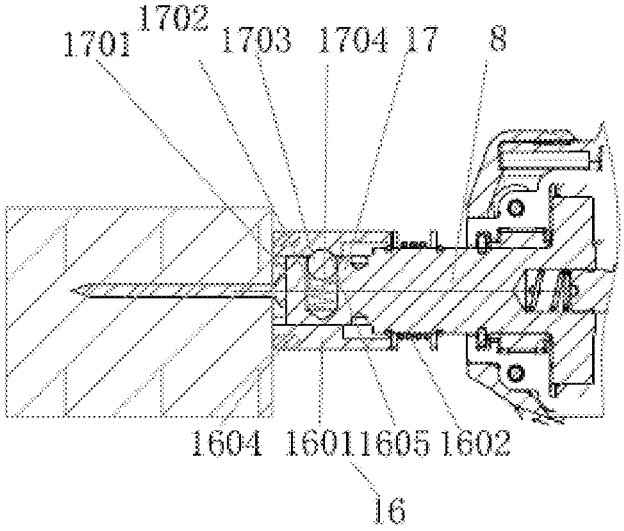
FIG. 11-B
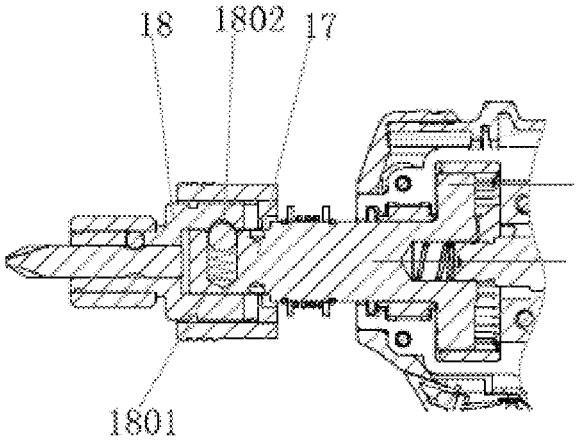
FIG. 12
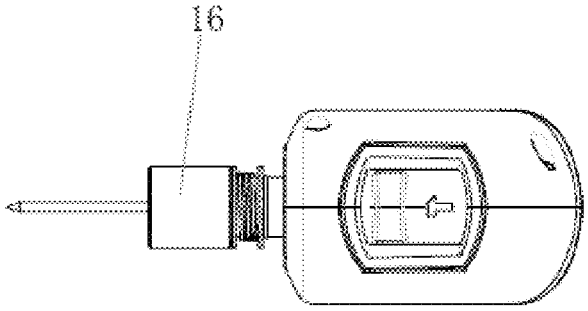
FIG. 13

MULTI-TOOL FOR FASTENERS

CROSS REFERENCE TO RELATED APPLICATIONS

This application is a nonprovisional application claiming priority from Chinese Patent Application Serial No. 201210016643.6, filed Jan. 19, 2012, entitled "A MULTI-TOOL FOR FASTENERS" and from Chinese Patent Application Serial No. 201210016595.0, filed Jan. 19, 2012, also entitled "A MULTI-TOOL FOR FASTENERS," both of which are incorporated herein by reference in their entireties.

FIELD OF THE DISCLOSURE

The present disclosure relates generally to hand-held power tools for fasteners and, more particularly, to a multi-tool for fasteners.

BACKGROUND OF RELATED ART

During the process of manufacturing wooden furniture and building wooden frame structure houses, fasteners such as screws, bolts, nails, and the like are commonly used. Currently, various hand tools or hand-hold power tools are utilized to operate these fasteners. For example, an electric screwdriver is used to drive the screws, and an electric spanner is used to drive the bolts, and an electric hammer is used to strike the nails. However, such tools are generally used to manipulate only one kind of fastener. For example, the electric hammer is only used to strike the nails but not to drive the screws. Therefore, during an operation, it is necessary for the operator to frequently change tools to manipulate different fasteners.

BRIEF DESCRIPTION OF THE DRAWINGS

FIG. 8-A is a cross-sectional view of an example output device in a beginning stage of a striking operation.

FIG. 8-B is a cross-sectional view of the example output device of FIG. 8-A in an ending stage of the striking operation.

FIG. 9 is a top view of the example output device in the striking operation.

FIG. 10 is a top view of the example output device in a rotating operation.

FIG. 11-A is a cross-sectional view of another example output device in a beginning stage of a striking operation.

FIG. 11-B is a cross-sectional view of the example output device of FIG. 11-A in an ending stage of the striking operation.

FIG. 12 is a cross-sectional view of the example output device assembled with a rotating accessory.

FIG. 13 is a top view of the example output device in the striking operation.

DETAILED DESCRIPTION

Figure 1:
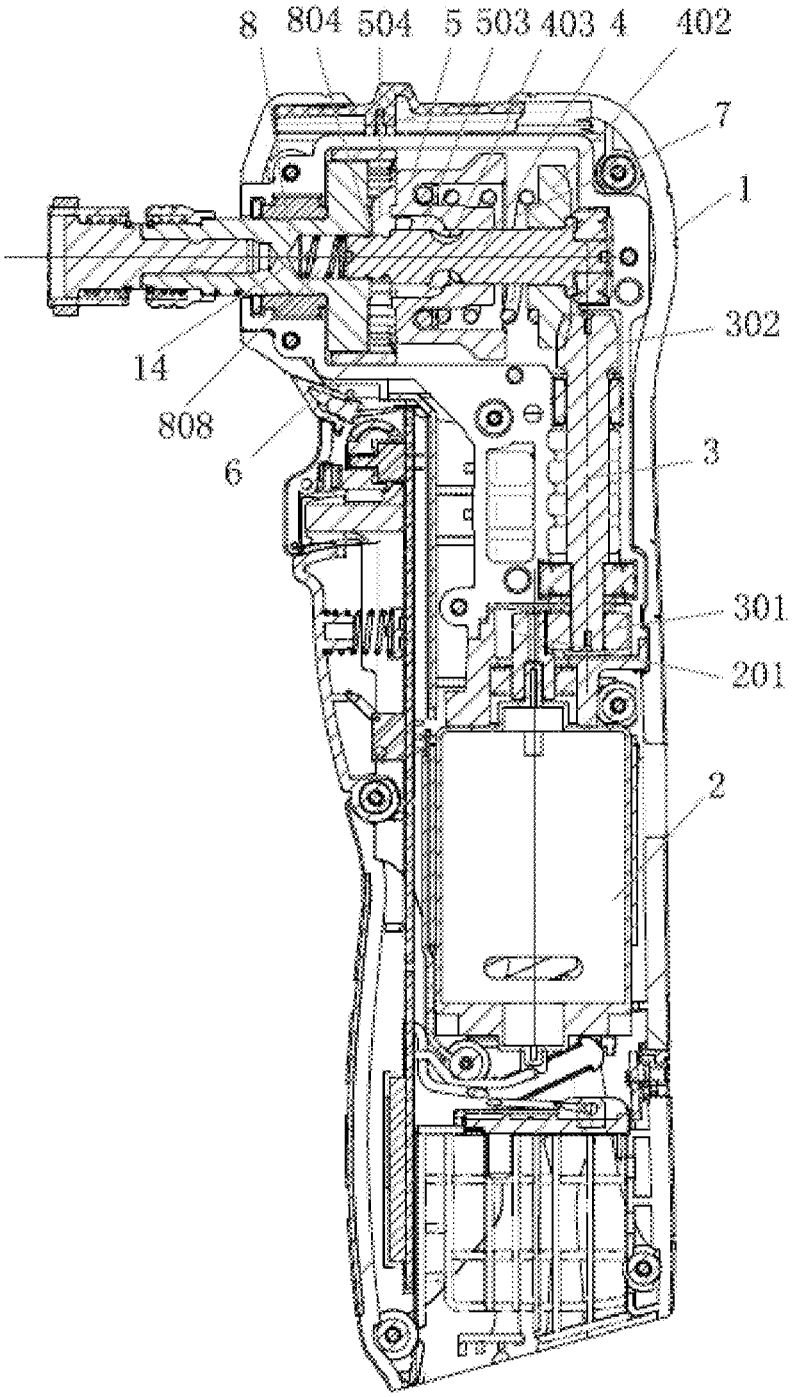
FIG. 1 is a cross-sectional view of an example multi-tool for fasteners.

The following disclosure of example multi-tools is not intended to limit the scope of the disclosure to the precise form or forms detailed herein. Instead the following disclosure is intended to be illustrative so that others may follow its teachings.

This disclosure proposes a multi-tool for fasteners that can be switched between different operating modes so that different fasteners, such as screws, bolts, nails, and the like, can be operated by one tool. An output device of the multi-tool can be switched between at least two operating modes so that different fasteners, such as screws, bolts, nails, and the like, can be operated by one tool.

In one example, the multi-tool for fasteners includes a housing, a power device, and a transmission device coupled to the power device. An output device may be coupled to the transmission device and can be switched between at least two operating modes. In a first operating mode, the output device moves in a reciprocating manner without rotating about an axial direction, and in a second operating mode, the output device rotates about a circumferential direction with an intermittently increasing torque. The example multi-tool may further include a switching device. In one example, the switching device includes a limiting member that is moveable between a first position and a second position. In the first position the output device is in the first operating mode, and in the second position the output device is in the second operating mode.

In one example multi-tool, the transmission device includes a hammer having a striking portion at one end thereof. Moreover, the output device may have a hammer anvil with an anvil portion that can engage the striking portion of the hammer. An engaging surface between the striking portion and the anvil portion may be configured to have an inclined surface and a curved surface.

In one example multi-tool, the hammer anvil includes a teeth portion arranged in the circumferential direction, and the limiting member is an inner gear ring, wherein in the first position the limiting member engages the teeth portion of the hammer anvil, and in the second position the limiting member disengages the teeth portion of the hammer anvil.

In one example multi-tool, a locating hole may exist in the hammer anvil, and the limiting member may be a locking pin. In the first position the limiting member engages with the locating hole of the hammer anvil, and in the second position the limiting member disengages from the locating hole of the hammer anvil.

In one example multi-tool, the limiting member is a locking ring, and at least one protruding portion is disposed on an inner side of the locking ring. In the first position, the protruding portion of the limiting member engages with the anvil portion of the hammer anvil, and in the second position, the protruding portion of the limiting member disengages from the anvil portion of the hammer anvil.

In one example multi-tool, at least one locating surface is defined on the periphery surface of the hammer anvil, and the limiting member is a locking rod having a notch. In the first position, the notch of the limiting member may be orientated opposite to the locating surface of the hammer anvil, and in the second position, the notch of the limiting member may be orientated towards the locating surface of the hammer anvil.

In one example multi-tool, the transmission device has a hammer and a hammer anvil, and the output device has an output shaft. The hammer may have a striking portion at one end thereof. Further, the hammer anvil may have an anvil portion that engages with the striking portion of the hammer at one end and a first engaging portion at the other end. The output shaft may have a second engaging portion at one end. Also, the first engaging portion can engage with the second engaging portion, and an engaging surface between the first engaging portion and the second engaging portion may be configured to have an inclined surface and a curved surface.

In one example multi-tool, the output shaft is provided with at least one locating surface on the periphery surface, and the limiting member is a locking rod having a notch. In the first position, the notch of the limiting member may be orientated opposite the locating surface of the output shaft, and in the second position, the notch of the limiting member may be orientated towards the locating surface of the output shaft.

In one example, the multi-tool further comprises a bias element disposed between the hammer and the hammer anvil to provide a biasing pressure along a direction for separating the hammer from the hammer anvil.

In one example multi-tool, the transmission device is coaxially connected to the output device.

In one example multi-tool, the output device comprises a strike-transmitting portion for transmitting striking forces in the first operating mode and a rotation-transmitting portion for transmitting torque in the second operating mode.

In one example multi-tool, the output device comprises a hammer anvil. Further, the rotation-transmitting portion may be a gripping head disposed on one end of the hammer anvil. In addition, the strike-transmitting portion may be a striking accessory connected to the gripping head.

In one example multi-tool, the striking accessory comprises a handle portion connected to the gripping head and a striking portion having a stressed end configured to contact the end of the hammer anvil.

In one example multi-tool, the output device comprises a hammer anvil, and the strike-transmitting portion is a rectangular head disposed on one end of the hammer anvil. Also, the rotation-transmitting portion may be a rotating accessory connected to the rectangular head.

In one example multi-tool, the strike-transmitting portion comprises a striking surface and a nail-accommodating mechanism.

In one example multi-tool, the striking surface is configured to have a plane surface, an inwards-concave surface, or an outwards-convex surface.

In one example multi-tool, the nail-accommodating mechanism comprises a sleeve protruding from the striking surface.

In one example, the multi-tool further comprises a magnetic element disposed at the periphery of the sleeve.

In one example multi-tool, the sleeve is made of non-magnetic conduction materials, and the magnetic element is a magnetic ring.

In one example multi-tool, the rotation-transmitting portion comprises a receiving portion for connecting with the fasteners and has a hexagon or square inner peripheral surface.

In addition, the multi-tool can be switched between different operating modes so as to adapt to different fasteners, such as screws, bolts, nails, and the like. The multi-tool not only enhances the work efficiency of the operator by preventing the operator from having to continually switch tools during operations, but also significantly reduces costs of tools by providing one tool that performs the functions of multiple tools.

Turning now to FIG. 1, one example of a multi-tool for fasteners includes a housing 1, a power device (not labeled), a transmission device (not labeled), an output device (not labeled), an on-off device (not labeled), and a switching device (not labeled). The housing 1 is configured in the form of a common hand-hold power tool, such as angle type, gun type, or palm type. The example power device includes a motor 2 disposed in the housing 1 and a battery portion. The example on-off device is disposed on a gripping portion of the housing 1 for turning the motor 2 on or off. Alternatively, the on-off device can be configured as a depressible button linked with the output device, so that the motor 2 can be turned on or off by pushing movements on the depressible button. The on-off device can also control the rotating speed of the motor 2 via the force exerted by the pushing movement. If the force on the depressible button is large, the rotating speed of the motor may be enhanced or the torque force may be increased. If the force on the depressible button is small, the rotating speed of the motor may be reduced or the torque force may be decreased.

In one example, the power device is connected to the transmission device and provides a first rotation torque to the transmission device. The example transmission device includes a first rotating shaft 3, a second rotating shaft 4, and a hammer 5. The example first rotating shaft 3 is provided with a pinion 301 and a small bevel gear 302 at two ends thereof, respectively, and the example pinion 301 is engaged with a pivot gear 201 on a pivot shaft of the motor. Further, the example second rotating shaft 4 is provided with a large bevel gear 402 at one end thereof, and the large bevel gear 402 is engaged with the small bevel gear 302 on the first rotating shaft 3. The example second rotating shaft 4 is also provided with a first groove 403. Moreover, the example hammer 5 is provided with a striking portion 504 at one end thereof and a second groove 503 on the inner side thereof. The hammer 5 can be made of one kind of material or more than one kind of material where the materials have different rigidities. If the hammer 5 is made of two materials each having a different rigidity, one of the materials may be a soft material. In addition, the hammer 5 is mounted around the second rotating shaft 4 in one example and connected therewith by a ball 6 that is received between the first groove 403 and the second groove 503.

Further, in one example a spring 7 is disposed between the hammer 5 and the large bevel gear 402 so as to provide a biasing pressure along the hammer in a direction away from the large bevel gear 402. In addition, the spring 7 can alternatively be replaced by a pair of magnetic rings that repel one another. In some examples, the transmission principle is that the pivot shaft of the motor drives the first rotating shaft 3 to rotate via engagement between the gears; the first rotating shaft 3 drives the second rotating shaft 4 to rotate via the engagement between the bevel gears; and the second rotating shaft drives the hammer 5 to rotate via the ball 6. Moreover, when the hammer 5 rotates against the resistance due to the movement of the ball 6 along the groove, the hammer 5 will move some distance towards the large bevel gear 402 against the biasing pressure of the spring 7, and then rotatably move to the initial position under the action of the biasing pressure of the spring 7. Due to the biasing pressure, the ball 6, the first groove 403, and the second groove 503, the hammer 5 can rotatably and axially move in a reciprocating manner on the second rotating shaft 4, thereby generating an intermittently increasing torque. In another example, the transmission device can alternatively be configured so as to omit the first rotating shaft 3. In other words, the pivot shaft of the motor can directly drive the second rotating shaft 4 to rotate via engagement between the gears.

In one example, the transmission device is coaxially connected to the output device and provides a second rotation torque and a biasing force to the output device. The example output device is connected to a multi-tool head to act on the fasteners. The output device can be a ¼ inch gripper or automatic one-handed gripper. Further, the output device can also comprise an additional rotating head. The output device of the multi-tool includes in one example a hammer anvil 8 that includes an anvil portion 804 to engage with the striking portion 504 of the hammer, wherein the engaging surface between the striking portion 504 and the anvil portion 804 is configured with an inclined surface or a curved surface. Moreover, the two engaging surfaces can be symmetrically disposed with the same inclined angle or asymmetrically disposed with different inclined angles, and also can be configured in such way that one of them is an inclined surface and the other is a vertical surface. In addition, the striking portion 504 and the anvil portion 804 comprise at least two pairs, so as to provide at least two contacting positions for striking when the hammer 5 and the hammer anvil 8 are operated for striking, namely, the hammer anvil 8 can have more than two pressured positions. As a result, it can effectively reduce the striking pressure to enhance the multi-tool lifetime.

Further, the contacting positions of the striking portion 504 and the anvil portion 804 can be made of hard materials in some examples so as to enhance the energy transmission efficiency between the hammer and the hammer anvil and prolong the service life of the members and the multi-tool generally. In some examples the hard materials comprise alloys. The transmission principle is that the movement of the hammer 5 is attributable to the rotation torque in the circumferential direction and the biasing force in the axial direction by the inclined surface or curved surface. The hammer anvil 8 may receive the rotation torque in the circumferential direction so as to rotatably move with an intermittently increasing torque, and the hammer anvil 8 may receive the biasing force in the axial direction, allowing it to move in a reciprocating manner in the axial direction, all of which can be controlled by the pushing movement of the operator on the on-off device.

The example switching device may include an operating member and a limiting member, and the operator may move the limiting member between a first position and a second position by controlling the operating member. In some examples, the operating member is disposed at a location on the housing where the hand of the operator can touch the operating member upon gripping the multi-tool. Thus, the operator can operate the multi-tool and switch operating modes with one hand. In the first position, the limiting member contacts the output device causing it to enter a first operating mode. At this time, the limiting member can limit the rotation of the output device in the circumferential direction, and with the pushing movement of the operator on the on-off device, the output device can move in a reciprocating manner without rotation about the axial direction. In the second position, the limiting member disengages from the output device causing the output device to enter a second operating mode. At this time, the circumferential limiting effect of the limiting member is prevented and the output device can simultaneously move in a reciprocating manner and rotate with an intermittently increasing torque about the axial direction.

Figure 2:
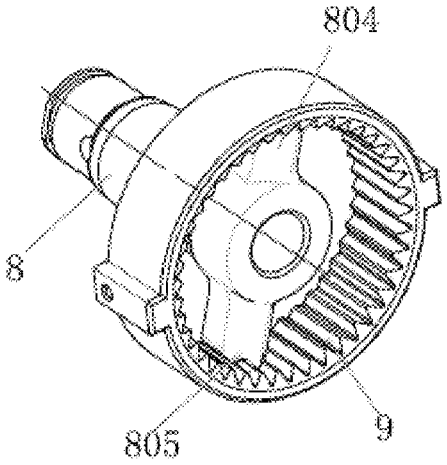
FIG. 2 is an isometric view of an example limiting member.

According to one example, as shown in FIG. 2, the hammer anvil 8 of the output device is provided with a teeth portion 805 extending along a circumferential direction, and the limiting member is an inner gear ring 9. In the first position, the inner gear ring 9 may engage with the teeth portion 805 of the hammer anvil 8 to limit the rotation of the hammer anvil 8 in the circumferential direction, so that the hammer anvil 8 can move in a reciprocating manner without rotating about the axial direction, all of which can be controlled by the pushing movement of the operator on the on-off device. In the second position, the inner gear ring 9 disengages from the teeth portion 805 of the hammer anvil 8, and the circumferential limiting effect of the hammer anvil 8 is prevented, so that the hammer anvil 8 can simultaneously move in a reciprocating manner and rotate with an intermittently increasing torque about the axial direction.

Figure 3:
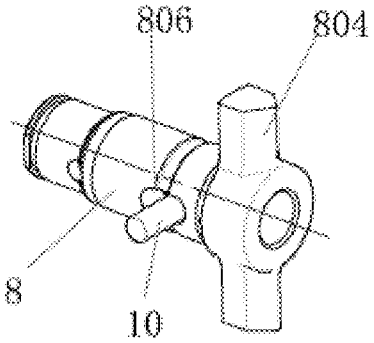
FIG. 3 is an isometric view of another example limiting member.

In another example, as shown in FIG. 3, the hammer anvil 8 of the output device includes a locating hole 806, and the limiting member is a locking pin 10. In the first position, the example locking pin 10 engages with the locating hole 806 of the hammer anvil 8 to limit the rotation of the hammer anvil 8 in the circumferential direction, so that the hammer anvil 8 can move in a reciprocating manner without rotating about the axial direction, all of which can be controlled by the pushing movement of the operator on the on-off device. In the second position, the example locking pin 10 disengages from the locating hole 806 of the hammer anvil 8, and the circumferential limiting effect of the hammer anvil 8 is prevented, so that the hammer anvil 8 can simultaneously move in a reciprocating manner and rotate with an intermittently increasing torque about the axial direction.

Figure 4:
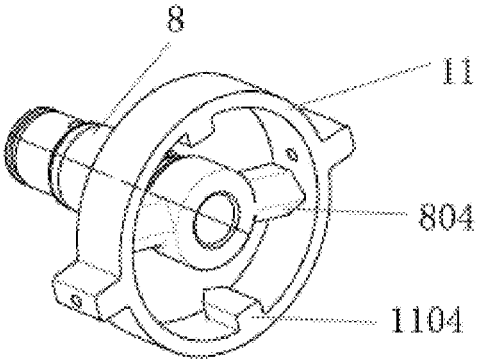
FIG. 4 is an isometric view of still another example limiting member.

In still another example, as shown in FIG. 4, the example limiting member is a locking ring 11, and at least one protruding portion 1104 is disposed on the inner side of the locking ring 11. In the first position, the locking ring 11 may be mounted around the hammer anvil 8 and the protruding portion 1104 of the locking ring 11 may be engaged with the anvil portion 804 of the hammer anvil 8 to limit the rotation of the hammer anvil 8 in the circumferential direction, allowing the hammer anvil 8 to move in a reciprocating manner without rotating about the axial direction, all of which can be controlled by the pushing movement of the operator on the on-off device. In the second position, the locking ring 11 may disengage from the hammer anvil 8, and the circumferential limiting effect of the hammer anvil 8 is prevented, so that the hammer anvil 8 can simultaneously move in a reciprocating manner and rotate with an intermittently increasing torque about the axial direction.

Figure 5:
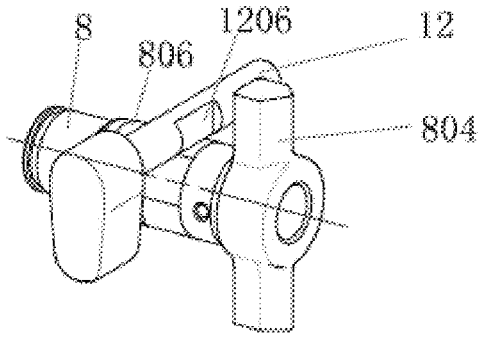
FIG. 5 is an isometric view of yet another example limiting member.

According to yet another example, as shown in FIG. 5, a periphery of the front end of the hammer anvil 8 includes at least one locating surface 806, and the limiting member is a locking rod 12 having a notch 1206. In the first position, the notch 1206 of the locking rod 12 may be orientated opposite the locating surface 806 on the periphery of the front end of the hammer anvil 8. As such, the locking rod 12 can limit the rotation of the hammer anvil 8 in the circumferential direction, allowing the hammer anvil 8 to move in a reciprocating manner without rotation about the axial direction, all of which can be controlled by the pushing movement of the operator on the on-off device. In the second position, the notch 1206 of the locking rod 12 may be orientated towards the locating surface 806 on the periphery of the front end of the hammer anvil 8, and thus the hammer anvil 8 can simultaneously move in a reciprocating manner and rotate with an intermittently increasing torque about the axial direction in the notch 1206 of the locking rod 12.

Figure 6:
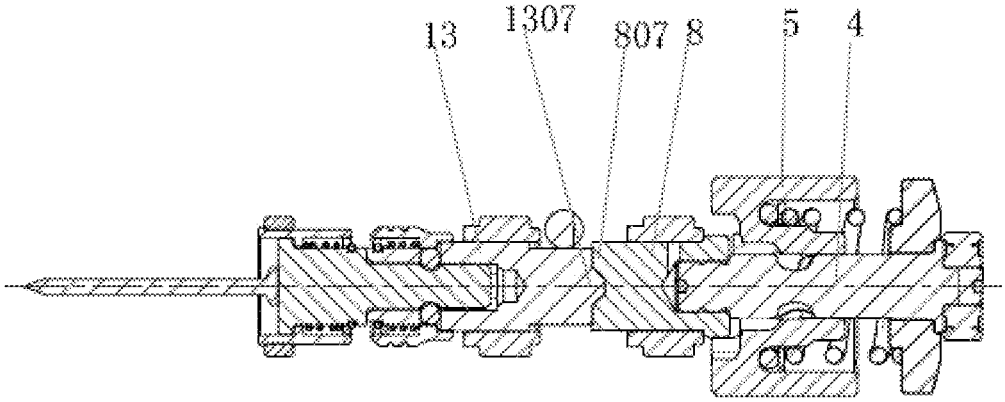
FIG. 6 is a cross-sectional view of another example multi-tool for fasteners.

Referring now to FIG. 6, another example multi-tool has an alternative transmission device and an alternative output device. In this example, the transmission device includes a hammer anvil 8, and the output device is an output shaft 13. The hammer anvil 8 has a first engaging portion 807 at the other end thereof. The example output shaft 13 is connected to a multi-tool head at one end and has a second engaging portion 1307 at the other end for engaging with the first engaging portion 807 of the hammer anvil 8, wherein the engaging surface there-between is configured as an inclined surface or a curved surface. Moreover, the engaging surface between the first engaging portion 807 and second engaging portion 1307 can can be symmetrically disposed with the same inclined angle or asymmetrically disposed with the different inclined angles, and also can be configured in such way that one of them is an inclined surface and the other is a vertical surface. The transmission principle is that the rotating movement of the hammer anvil 8 is attributable to the rotation torque in the circumferential direction and the biasing force in the axial direction by the inclined surface or the curved surface. The output shaft 13 may receive the rotation torque in the circumferential direction, allowing it to rotatably move with an intermittently increasing torque. The output shaft 13 receives the biasing force in the axial direction, thus it can move in a reciprocating manner in the axial direction, all of which can be controlled by the pushing movement of the operator on the on-off device.

Figure 7:
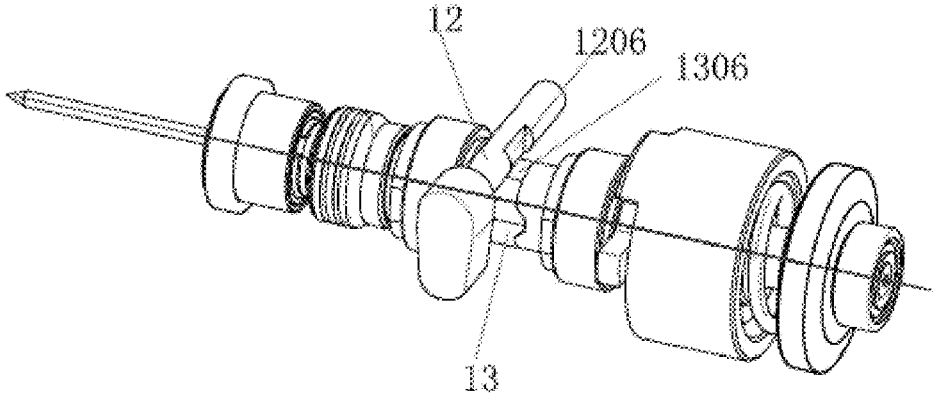
FIG. 7 is an isometric view of an example limiting member.

According to one example, as shown in FIG. 7, the periphery of the example output shaft 13 is provided with at least one locating surface 1306, and the limiting member is a locking rod 12 having a notch 1206. In the first position, the notch 1206 of the locking rod 12 may be orientated opposite the locating surface 1306 on the periphery of the output shaft 13, and then the locking rod 12 can limit the rotation of the output shaft 13 in the circumferential direction, allowing the output shaft 13 to move in a reciprocating manner without rotation in the axial direction, all of which can be controlled by the pushing movement of the operator on the on-off device. In the second position, the notch 1206 of the locking rod 12 may be orientated towards the locating surface 1306 on the periphery of the output shaft 13, and thus the output shaft 13 can simultaneously move in a reciprocating manner and rotate with an intermittently increasing torque about the axial direction in the notch 1206 of the locking rod 12.

In some example multi-tools, the output device includes a strike-transmitting portion for transmitting striking force to the fasteners such as nails and a rotation-transmitting portion for transmitting torque to the fasteners such as screws. The portion of the strike-transmitting portion that acts on the fasteners may be defined as a striking portion, and the striking portion includes a striking surface that is configured as one of a plane surface, a concave surface, or a convex surface. In some examples, the striking portion can be provided with an additional nail-support mechanism on the periphery thereof. The nail-support mechanism may include a sleeve, an elastic element and a stopper element. The elastic element may be disposed between the sleeve and the striking portion and can be configured as a spring so as to provide a biasing pressure to the sleeve in the axial direction. The stopper element may be disposed on the periphery of the striking portion to provide a resistance to the sleeve in a direction opposite the direction of the biasing pressure of the elastic element. As a result of the biasing pressure of the elastic element and the resistance of the stopper element, the sleeve can be retained in a position at which the sleeve protrudes from the striking surface for a length. In one example, the length is slightly greater than the diameter of the head of the fastener such as nails. The operating principle of the nail-support mechanism is that during the striking operation, the fastener is limited in a range defined by the sleeve and the striking surface, so as to avoid the fastener sliding out from the striking surface to cause an unsuccessful striking This can effectively enhance not only the stability but also the safety of the striking operation. When the head of the fastener approaches the operating surface, the operating surface may abut against the sleeve to cause it to move backwards against the elastic biasing pressure under the action of the pushing movement on the on-off device by the operator, so that the effect on the striking operation can be avoided. Moreover, a magnetic element can also be disposed at the periphery of the sleeve to attract the fastener, which is helpful for the nail-support mechanism to retain the stability of the fastener during the operation. In one example, the magnetic element is a magnetic ring and the sleeve is made of non-magnetic, conductive materials.

As shown in FIG. 8-A and FIG. 8-B, the rotation-transmitting portion of the output device may in one example be configured as a gripping element 14 disposed on the end of the hammer anvil, and the strike-transmitting portion may be configured as a striking accessory 15 connected to the gripping element 14.

In some examples, the gripping element 14 is located at the output end of the hammer anvil 8 and includes a receiving portion 1401 and a casing 1402. The receiving portion 1401 may have a hexagon circumferential surface and may be disposed in the output end of the hammer anvil 8, wherein the circumferential surface is provided with two holes 1403, which, respectively, have diameters gradually increasing from the inside to the outside. The periphery of the receiving portion 1401 can mate with the casing 1402, and a convex portion 1404 and a concave portion 1405 may be disposed adjacent one another within the casing 1402. Further, a spring 1406 may be disposed between the receiving portion 1401 and the casing 1402 to provide a biasing pressure along the direction of the end of the hammer anvil. The receiving portion 1401 may also include a stopper element 1407 at the periphery thereof. The stopper element 1407 can provide resistance in a direction opposite the direction of the biasing pressure of the spring. As a result of the biasing pressure of the spring 1406 and the resistance of the stopper element 1407, the casing 1402 can be retained in a position at which the convex portion 1404 may face the hole 1403. A locking element 1408 may be disposed between the convex portion 1404 and the hole 1403, and a portion of the locking element 1408 can pass through the hole to enter into the receiving portion 1401. In one example, the locking element 1408 is a steel ball. By biasing and moving the casing 1402 against the spring, the concave portion 1405 may face the hole 1403, and then the locking element 1408 can move radially in a space formed between the concave portion 1405 and the hole 1403.

Further, the striking accessory 15 may be removably connected to the gripping element 14 and may include a handle portion 1501 and a striking portion 1502. The outer circumferential surface of the example handle portion 1501 is configured as a hexagonal surface to match the inner circumferential surface 1401 of the receiving portion of the gripping element 14. The striking portion 1502 may have a stressed end 1503 configured to contact the end of the output end of the hammer anvil 8 and configured to transfer the axial striking force from the hammer anvil 8, and a striking surface 1504 located at the other surface opposite the stressed end to contact the fastener.

In one example, the nail-support mechanism 16 is disposed at the periphery of the striking accessory 15 and includes a sleeve 1601, a spring 1602, and a stopper flange 1603. A magnetic ring 1604 may be disposed at the periphery of the example sleeve 1601. Reference will now be made to FIG. 8-A and FIG. 8-B, which illustrate the states of the nail-support mechanism 16 at the beginning and ending stages of the striking operation. At the beginning stage and during the striking operation, the example nail-support mechanism 16 may be in a state as shown in FIG. 8-A, wherein the sleeve 1601 protrudes from the striking surface 1504 for a length. At the ending stage of the striking operation, the example nail-support mechanism 16 may be in a state as shown in FIG. 8-B, wherein the sleeve 1601 gradually moves backwards against the biasing pressure of the spring 1602 and finally moves to a position flush with the striking surface 1504.

Referring to FIG. 9, when the striking operation is required for striking fasteners such as nails, the striking accessory 15 may be connected to the gripping element 14 and the operating member of the switching device may be pushed to a hammer mode. Referring to FIG. 10, when the rotating operation is required for rotating the fasteners such as screws, the striking accessory 15 may be replaced by a multi-tool head matching a head of the fastener and the operating member of the switching device may be pushed to a rotation mode.

As shown in FIG. 11-A and FIG. 11-B, the strike-transmitting portion of the output device may in one example be configured as a rectangular head 17 disposed on the end of the hammer anvil, and the rotation-transmitting portion may be configured as a rotating accessory 18 connected to the rectangular head 17.

Since the output end of the hammer anvil 8 is configured as the rectangular head 17 in this example, the rectangular head portion may be the striking portion, and the end surface 1701 of the rectangular head may be the striking surface. The example rectangular head is provided with a receiving hole 1702 in which a locking element 1703 is located. A spring 1704 may be disposed between the receiving hole 1702 and the locking element 1703. In one example the locking element 1703 is a steel ball. The locking element 1703 may be disposed in the receiving hole 1702 against the biasing pressure of the spring 1704, and a portion of the locking element 1703 may protrude from the receiving hole 1702.

When the striking operation is needed, the nail-support mechanism 16 can also be disposed on the rectangular head. The sleeve 1601 of the nail-support mechanism may include at least one recess 1605 on the inner side thereof, and the recess 1605 can mate with the locking element 1703, which partially protrudes from the receiving hole 1702 in this example. The magnetic ring 1604 may be disposed at the periphery of the sleeve 1601. One end of the example sleeve 1601 may be connected to the hammer anvil 8 via the spring 1602, and the spring 1602 may provide a biasing pressure to the sleeve 1601 along the direction of the end surface 1701 of the rectangular head. Under the action of the biasing pressure provided by the spring 1602 and the resistance provided by the locking element 1703, the sleeve 1601 can be retained in a position at which the sleeve protrudes from the end surface 1701 of the rectangular head for a length.

Reference is now made to FIG. 11-A and FIG. 11-B, which illustrate example states of the nail-support mechanism 16 at the beginning and ending stages of the striking operation. At the beginning stage and during the striking operation, as shown in the example of FIG. 11-A, the sleeve 1601 protrudes from the end surface 1701 of the rectangular head for a length, while at the ending stage of the striking operation, the sleeve 1601 gradually moves backwards against the biasing pressure of the spring 1602 and finally moves to a position flush with the end surface 1701 of the rectangular head.

Referring to FIG. 12, when the rotating operation is needed, the rotating accessory 18 may be mounted around the rectangular head 17. The rotating accessory 18 may in some examples be regarded as the rotation-transmitting portion. Moreover, the inner circumferential surface 1801 of the receiving portion of the rotating accessory 18 for mounting around the rectangular head 17 may be configured in the shape of a square, allowing the rotating accessory 18 to mate with the rectangular head 17. The rotating accessory 18 may have at least one recess 1802, which can mate with the locking element 1703 that partially protrudes from the receiving hole 1702. In one example, to receive the handle portion of the multi-tool head for fasteners such as screws, the portion of the rotating accessory 18 that protrudes from the rectangular head may have the same configuration as the above gripping element.

Figure 14:
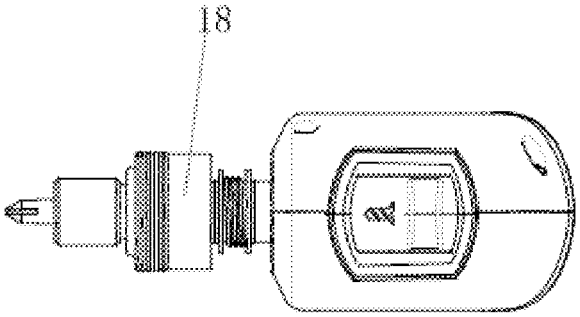
FIG. 14 is a top view of the example output device in the rotating operation.

Referring to FIG. 13, when the striking operation is needed for striking fasteners such as nails, the example nail-support mechanism 16 can be connected to the rectangular head 17, and the operating member of the switching device can be pushed to the hammer mode. Referring to FIG. 14, when the rotating operation is needed to rotate fasteners such as screws, the nail-support mechanism 16 may be replaced by the rotating accessory 18 and the operating member of the switching device may be pushed to the rotation mode.

In some example multi-tools, the limiting member may include a circumferential limiting portion and an axial limiting portion. In the first position, the circumferential limiting portion of the limiting member acts on the output device and the axial limiting member disengages from the output device. The output device may then operate in the first operating mode, and the limiting member can limit the rotation of the output device in the circumferential direction and the output device can move in a reciprocating manner without rotation in the axial direction, all of which can be controlled by the pushing movement of the operator on the on-off device. In the second position, the circumferential limiting portion of the limiting member disengages from the output device and the axial limiting portion acts on the output device. The output device may then operate in the second operating mode, and the limiting member limits the movement of the output device along the axial direction, allowing the output device to rotate with an intermittently increasing torque about the circumferential direction.

In some examples, the multi-tool has five operating modes. In the first operating mode, the limiting member limits the rotation of the output device in the circumferential direction, and the output device can move in a reciprocating manner without rotation in the axial direction (i.e., the output device is operated in the striking mode). In the second operating mode, the limiting member limits the movement of the output device in the axial direction, and the output device can rotate with an intermittently increasing torque about the circumferential direction (i.e., the output device is operated in the rotating-striking mode). In the third operating mode, the limiting effect of the limiting member to the output device is prevented, and the output device can simultaneously move in a reciprocating manner in the axial direction and rotate with an intermittently increasing torque about the circumferential direction (i.e., the output device is operated in a combination mode). In the fourth operating mode, the limiting member limits the movement of the hammer in the axial direction, and the output device can rotate with constant torque about the circumferential direction and move in a reciprocating manner in the axial direction (i.e., the output device is operated in the striking-rotating mode). In the fifth operating mode, the limiting member limits the movement of the hammer in the axial direction and the movement of the output device in the axial direction, and the output device can rotate with constant torque about the circumferential direction (i.e., the output device is operated in the rotating mode). Therefore, the multi-tool can be switched between different operating modes by controlling the location of the limiting member, so that the operator can choose an appropriate operating mode according to the working conditions.

In some examples, the multi-tool includes a biasing element disposed between the hammer 5 and the hammer anvil 8 to provide a biasing pressure along a direction for separating the hammer 5 from the hammer anvil 8. One example purpose of the biasing element is that the biasing element can keep the hammer 5 separated from the hammer anvil 8 before the pushing action of the operator on the on-off device so as to cut the energy transmission between the hammer 5 and the hammer anvil 8, which can not only reduce the energy dissipation during the operation pause, but also effectively prevent potential safety hazard caused by accidental activation of the multi-tool. Thus, the multi-tool enters an operating mode only when the operator performs the pushing movement on the on-off device.

In another example, with reference to FIG. 1, the hammer anvil 8 includes a receiving portion 808 in which the end of the second rotating shaft is located. The spring 14 may be disposed between the hammer anvil 8 and the second rotating shaft 4 to provide a biasing pressure in a direction that separates the second rotating shaft 4 from the hammer anvil 8 so that the hammer 5 and the hammer anvil 8 are kept in a disengaged state. Moreover, the receiving portion can alternatively be disposed on the end of the second rotating shaft 4. Further, the spring can alternatively be replaced by a pair of magnetic rings which repels each other.

In some examples, the multi-tool further includes an LED indicator light on the housing 1, which can be turned on when the motor is started by the on-off device. Moreover, the LED indicator light can also indicate the capacity of the battery portion in the power device. In particular, if the capacity of the battery portion has decreased to a certain value, the operator will be alarmed by the reduced brightness, changed color, or flashing of the LED indicator light so as to replace or charge up the battery. In addition, in some examples, the LED indicator light can be disposed in a switch trigger of the on-off device. Further, in some examples, the visible operating area on the housing 1 can also be provided with an LCD screen to display the torque force values or torque force curved line of the multi-tool.

In some example multi-tools, the striking frequency of the hammer and the hammer anvil can be controlled by adjusting the rotating speed of the motor via the on-off device. Moreover, the multi-tool may have different striking frequency modes for various types of the fasteners. The operator can adjust the striking frequency and/or the resonance to make the multi-tool efficient depending on the type of fastener. Moreover, the striking manner of the hammer and the hammer anvil can also be controlled by adjusting the rotating speed of the motor via the on-off device, wherein the striking manner includes single-striking manner and continuous-striking manner.

In some examples the multi-tool includes a regulating device for torque force that can regulate the output device so as to output a constant amount of torque force. In addition, the regulating device for torque force may further include a feedback system to modify the output of the torque force from the output device according to the working conditions.

In some examples the multi-tool further includes a controlling member. When the operator replaces the multi-tool head based on a different fastener type, the controlling member can identify the type of the replaced multi-tool head and alarm the operator to choose the corresponding operating mode for the fasteners or control the switching device to automatically switch to the corresponding operating mode. In one example, since the multi-tool head for striking and the multi-tool head for rotating have different contacting surfaces with regard to the output device, a sensor may be provided on respective contacting surfaces. The sensor can generate corresponding sensed signals when different multi-tool heads are installed. The controlling member detects the sensed signals and determines the relevant operating mode to alarm the operator or automatically switch the operating mode.

In some example multi-tools, a portion of the housing that envelopes the transmission device and the output device is defined as an operating portion, and a portion of the housing that envelopes the motor and the battery portion is defined as a body portion. A shock mitigation system may be disposed in the part of the housing between the operating portion and the body portion. Specifically, this part of housing is made of soft material. Thus it can effectively enhance the comfort level of the operator gripping the multi-tool. Moreover, the on-off device can be disposed at several positions to meet the requirements of various working conditions, for example, the on-off device can be disposed at the operating portion, the gripping position, or the tail portion on the body portion.

When the multi-tool is used to strike nails, the multi-tool can be switched to the first operating mode by adjusting the switching device, and the output device of the multi-tool may be pressed on the head of the nail. The on-off device may then be turned on, and the output device of the multi-tool strikes in a reciprocal manner. If the fasteners are screws or bolts, the multi-tool can be switched to the second operating mode by adjusting the switching device, and the output device of the multi-tool may be mated with the screws or bolts. The on-off device may then be turned on, and the output device of the multi-tool rotates with an intermittently increasing torque.

Although certain example multi-tools have been disclosed herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A multi-tool for fasteners comprising:

a housing;

a power device;

a transmission device coupled to the power device;

an output device coupled to the transmission device having at least two operating modes, wherein in a first operating mode the output device moves in a reciprocating manner without rotating along an axial direction, wherein in a second operating mode the output device rotates with an intermittently increasing torque along a circumferential direction; and a switching device having a limiting member, the limiting member being moveable between a first position and a second position, wherein the output device is in the first operating mode in the first position, wherein the output device is in the second operating mode in the second position, wherein the transmission device comprises a hammer having a striking portion at one end thereof, wherein the output device comprises a hammer anvil having an anvil portion to engage the striking portion of the hammer, and wherein an engaging surface between the striking portion and the anvil portion has at least one of an inclined surface or a curved surface.

2. A multi-tool for fasteners of claim 1, wherein the hammer anvil further comprises a teeth portion extending along the circumferential direction, wherein the limiting member is an inner gear ring, wherein the limiting member engages the teeth portion of the hammer anvil in the first position, wherein the limiting member disengages the teeth portion of the hammer anvil in the second position.

3. A multi-tool for fasteners of claim 1, wherein the hammer anvil further comprises a locating hole, wherein the limiting member is a locking pin, wherein in the first position the limiting member engages the locating hole of the hammer anvil, wherein in the second position the limiting member disengages the locating hole of the hammer anvil.

4. A multi-tool for fasteners of claim 1, wherein the limiting member is a locking ring, wherein at least one protruding portion is disposed on the inner side of the locking ring, wherein in the first position the protruding portion engages the anvil portion of the hammer anvil, wherein in the second position the protruding portion disengages the anvil portion of the hammer anvil.

5. A multi-tool for fasteners of claim 1, further comprising at least one locating surface on a periphery surface of the hammer anvil, wherein the limiting member is a locking rod having a notch, wherein in the first position the notch of the limiting member is orientated opposite the locating surface of the hammer anvil, wherein in the second position the notch of the limiting member is orientated towards the locating surface of the hammer anvil.

6. A multi-tool for fasteners of claim 1, further comprising a biasing element disposed between the hammer and the hammer anvil, the biasing element providing a biasing pressure in a direction to separate the hammer from the hammer anvil.

7. A multi-tool for fasteners of claim 1, wherein the transmission device comprises a hammer and a hammer anvil, wherein the output device comprises an output shaft, wherein the hammer comprises a striking portion at one end thereof, the hammer anvil having an anvil portion that engages the striking portion of the hammer at one end and a first engaging portion at the other end, the output shaft having a second engaging portion at one end, wherein the first engaging portion can engage the second engaging portion, wherein an engaging surface between the first engaging portion and the second engaging portion has an inclined surface and a curved surface.

8. A multi-tool for fasteners of claim 7, wherein the output shaft further comprises at least one locating surface on a periphery surface, wherein the limiting member is a locking rod having a notch, wherein in the first position the notch of the limiting member is orientated opposite the locating surface of the output shaft, wherein in the second position the notch of the limiting member is orientated towards the locating surface of the output shaft.

9. A multi-tool for fasteners of claim 1, wherein the transmission device is coaxially connected to the output device.

10. A multi-tool for fasteners of claim 1, wherein, the output device comprises a strike-transmitting portion for transmitting a striking force in the first operating mode and a rotation-transmitting portion for transmitting torque in the second operating mode.

11. A multi-tool for fasteners of claim 10, wherein the output device comprises a hammer anvil, wherein the rotation-transmitting portion is a gripping head disposed on one end of the hammer anvil, wherein the strike-transmitting portion is a striking accessory connected to the gripping head.

12. A multi-tool for fasteners of claim 11, wherein the striking accessory comprises a handle portion connected to the gripping head and a striking portion having a stressed end configured to contact the end of the hammer anvil.

13. A multi-tool for fasteners of claim 10, wherein the output device comprises a hammer anvil, wherein the strike-transmitting portion is a rectangular head disposed on one end of the hammer anvil, wherein the rotation-transmitting portion is a rotating accessory connected to the rectangular head.

14. A multi-tool for fasteners of claim 10, wherein the strike-transmitting portion comprises a striking surface and a nail-accommodating mechanism.

15. A multi-tool for fasteners of claim 14, wherein the striking surface is configured to have at least one of a plane surface, an inwards-concave surface, or an outwards-convex surface.

16. A multi-tool for fasteners of claim 14, wherein the nail-accommodating mechanism comprises a sleeve protruding from the striking surface.

17. A multi-tool for fasteners of claim 16, further comprising a magnetic element positioned at a periphery of the sleeve.

18. A multi-tool for fasteners of claim 17, wherein the sleeve is comprised of non-magnetic conduction materials, wherein the magnetic element is a magnetic ring.

19. A multi-tool for fasteners of claim 10, wherein the rotation-transmitting portion comprises a receiving portion for connecting with fasteners, the receiving portion having a hexagonal or square inner peripheral surface.

* * * * *